US006517345B1

(12) United States Patent
Wu

(10) Patent No.: US 6,517,345 B1
(45) Date of Patent: Feb. 11, 2003

(54) GAS STOVE

(76) Inventor: Chung Kuang Wu, P.O. Box 82-144, Taipei (TW)

( * ) Notice: Subject to any disclaimer, the term of this patent is extended or adjusted under 35 U.S.C. 154(b) by 0 days.

(21) Appl. No.: 10/022,531

(22) Filed: Dec. 20, 2001

(51) Int. Cl.[7] ..... F23D 14/28
(52) U.S. Cl. ..... 431/344
(58) Field of Search ..... 431/344; 126/40, 126/25 R, 25 AA, 9 R, 227

(56) References Cited

U.S. PATENT DOCUMENTS

| | | | | | |
|---|---|---|---|---|---|
| 367,170 | A | * | 7/1887 | Warnecke | 126/25 R |
| 2,638,085 | A | * | 5/1953 | Guedon | 126/40 |
| 4,082,993 | A | * | 4/1978 | Oakes | 137/322 |
| 4,545,759 | A | * | 10/1985 | Giles et al. | 431/344 |
| 6,302,096 | B1 | * | 10/2001 | Ducan | 126/38 |

* cited by examiner

*Primary Examiner*—Henry Bennett
*Assistant Examiner*—Alfred Basichas
(74) *Attorney, Agent, or Firm*—Leong C. Lei

(57) ABSTRACT

A stove which includes a cylindrical casing having open top, a cover engaged with the open top of the cylindrical casing and having a center hole in which is fitted a plug, the plug having a recess formed with internal threads and an orifice on a bottom thereof, a stop pin provided on a top of the cover, an adjusting disc having a center through hole and a circular groove on a bottom side thereof adapted to engage with the stop pin, a tubular member having an upper and a lower portions, the upper portion having an air hole for letting in air to mix with fuel gas, the lower portion being formed with threads adapted to engage with the internal threads of the Plug and an outlet below the threads, a funnel-shaped member mounted on the upper portion of the tubular member, and a burner arranged inside the funnel-shaped member and sleeved over an upper portion of the tubular member.

7 Claims, 4 Drawing Sheets

GAS STOVE

BACKGROUND OF THE INVENTION (a) Technical Field of the Invention

The present invention relates to an improvement in the structure of a gas stove.

(b) Description of the Prior art

The conventional gas stove is simply an appliance for cooking or heating, i.e. an appliance that burns a fuel to produce heat for cooking or for heating. However, the conventional gas stove must be connected with a gas tank via a flexible pipe thereby making it inconvenient in carrying. As to the alcohol burner, it will often cause fire accident if fallen down inadvertently. The Bensun laboratory gas burner is a portable tube-shaped gas burner with an adjustable hole to control air intake and flame type, used in laboratories, but it is still necessary to connect with a gas tank. Regarding the kerosene lamp, it is necessary to pump a large amount of air into the lamp periodically for keeping kerosene to burn and the fire will go into the kerosene container under certain circumstances to cause explosion.

Therefore, it is an object of the present invention to provide an improvement in the structure of a gas stove which can obviate and mitigate the above-mentioned drawbacks.

SUMMARY OF THE INVENTION

This invention is related to an improvement in the structure of a gas stove.

It is the primary object of the present invention to provide an improved gas stove which does not require an additional gas tank for supplying fuel gas.

It is another object of the present invention to provide an improved gas stove which is convenient to carry.

It is still another object of the present invention to provide an improved gas stove which can be refilled with fuel gas as required.

It is still another object of the present invention to provide an improved gas stove which is safe and easy to adjust in flowrate.

It is a further object of the present invention to provide an improved gas stove which is fit for use outdoors and indoors.

According to a preferred embodiment of the present invention, a stove which includes a cylindrical casing having open top, a cover engaged with the open top of the cylindrical casing and having a center hole in which is fitted a plug, the plug having a recess formed with internal threads and an orifice on a bottom thereof, a stop pin provided on a top of the cover, an adjusting disc having a center through hole and a circular groove on a bottom side thereof adapted to engage with the stop pin, a tubular member having an upper and a lower portions, the upper portion having an air hole for letting in air to mix with fuel gas, the lower portion being formed with threads adapted to engage with the internal threads of the plug and an outlet below the threads, a funnel-shaped member mounted on the upper portion of the tubular member, and a burner arranged inside the funnel-shaped member and sleeved over an upper portion of the tubular member.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESERTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
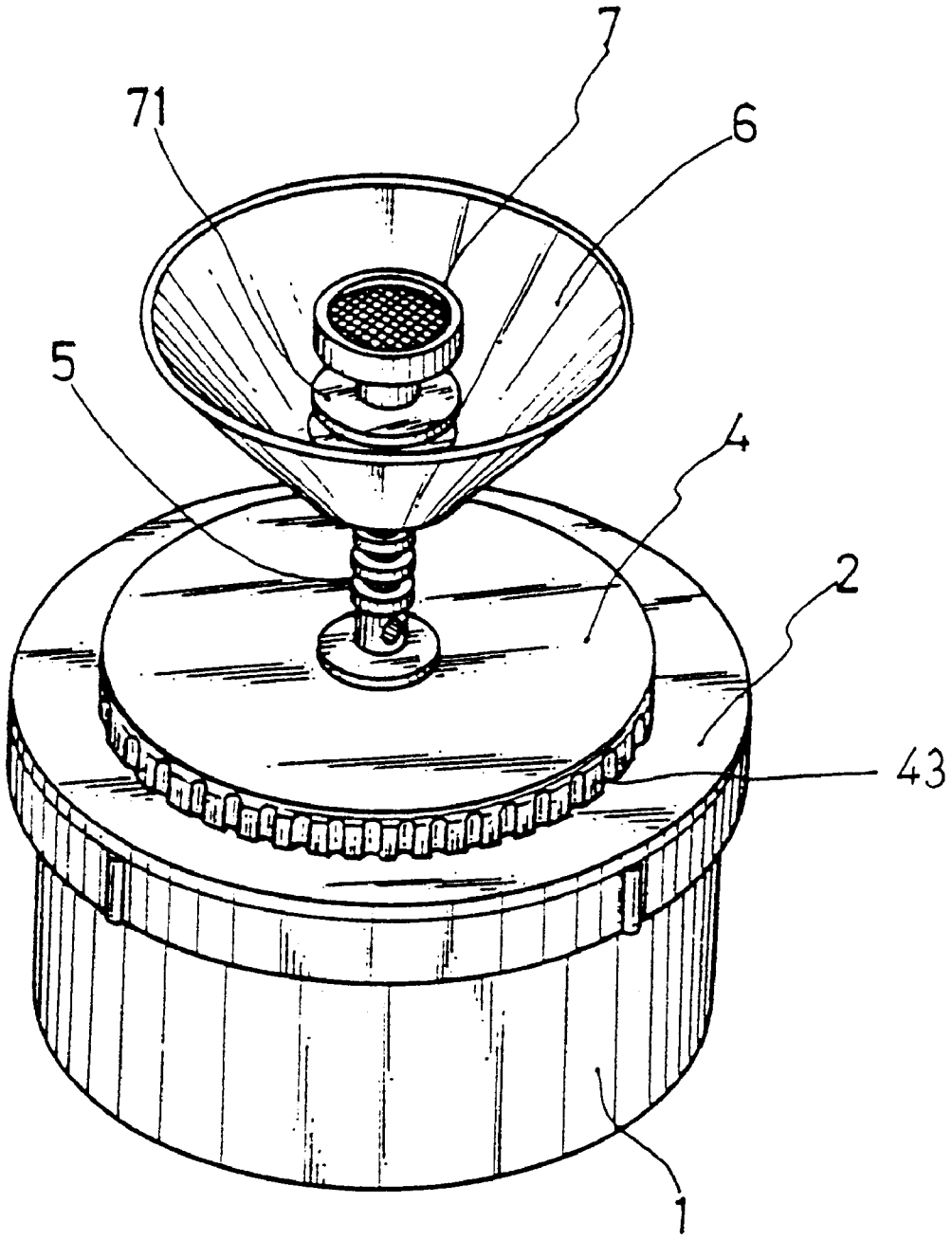
FIG. 1 is a perspective view of the present invention.
Figure 2:
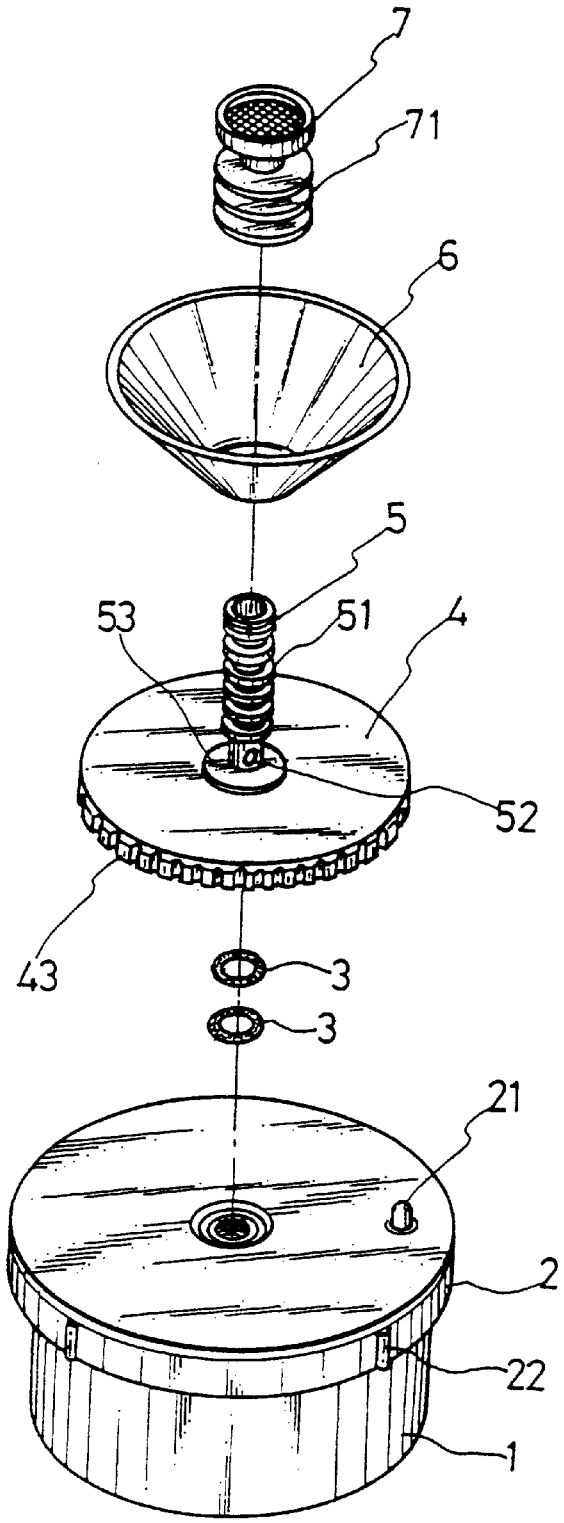
FIG. 2 is an exploded view of the present invention.
Figure 3:
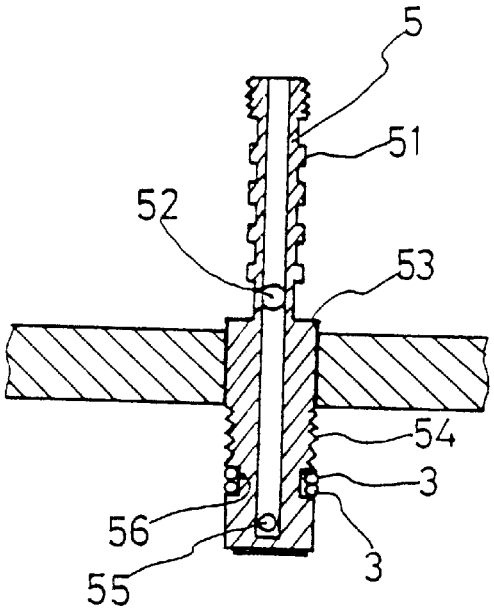
FIG. 3 is a sectional of the tubular member.
Figure 4:
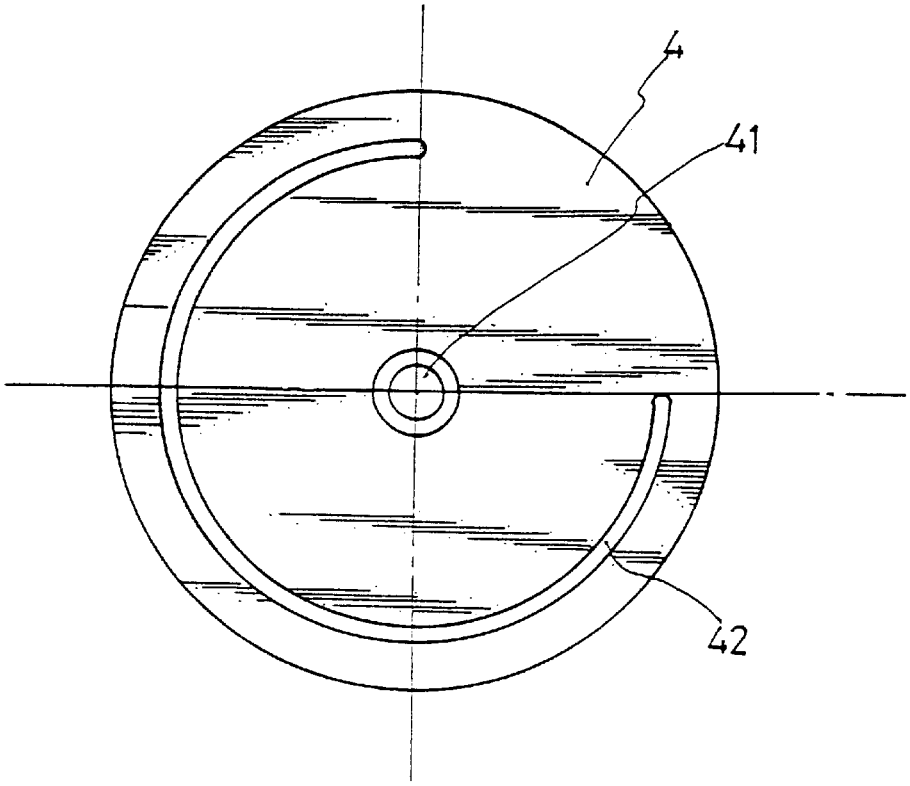
FIG. 4 is a bottom view of the adjusting disc.
Figure 5:
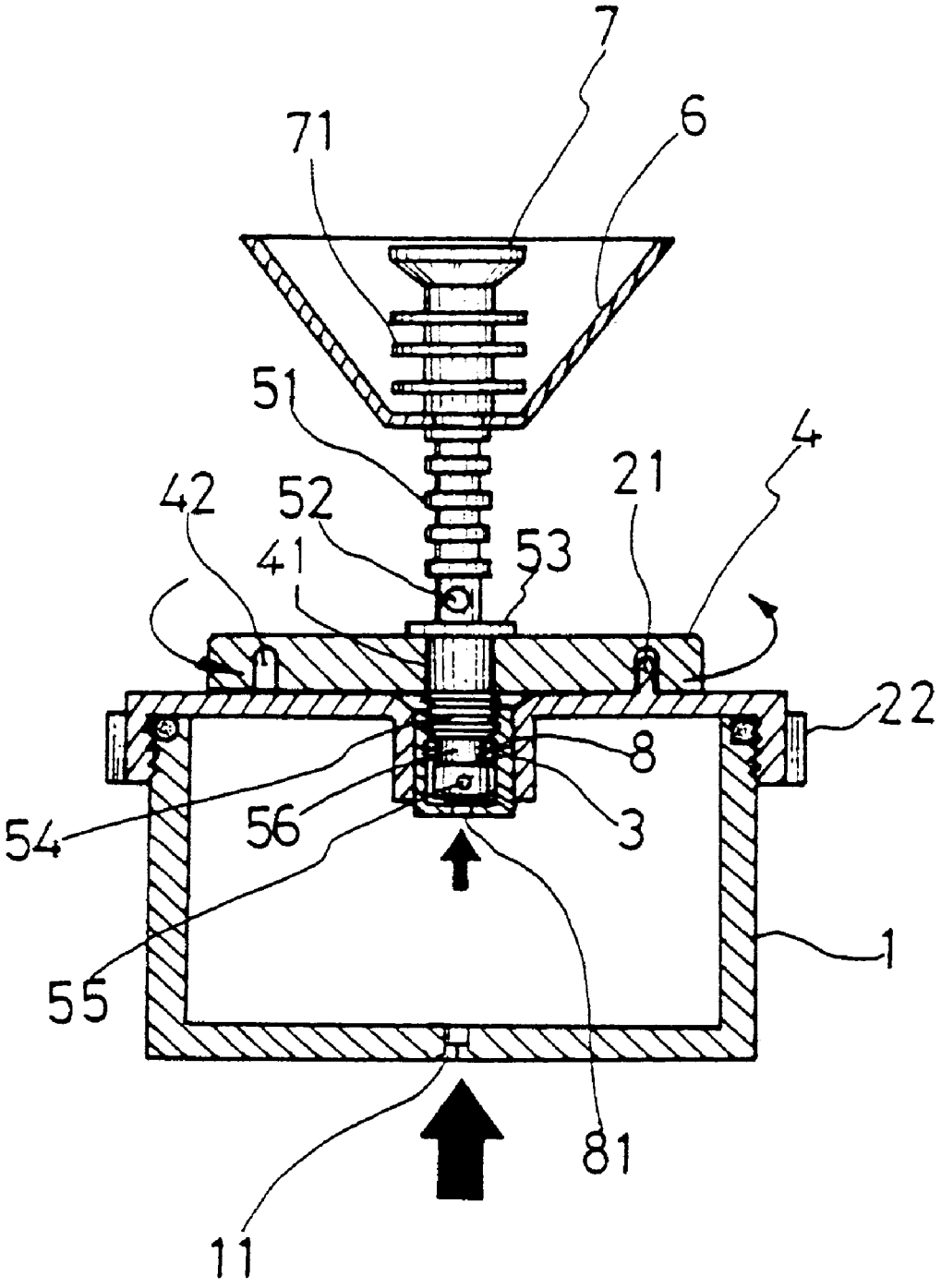
FIG. 5 is a sectional view of the present invention.

With reference to the drawings and in particular to FIGS. 1, 2 and 4 thereof, the gas stove according to the present invention generally comprises a container 1, a cover 2, two packing rings 3, an adjusting disc 4, a tubular member 5, a funnel-shaped member 6 and a burner 7. The container 1 is a cylindrical casing with an open top for receiving fuel and a check valve 11 at the bottom for filling gas into the container 1. The cover 2 is threadedly engaged with the open top of the container 1 and has a centre hole in which is force-fitted a plug 8. A stop pin 21 is provided on the top of the cover 2. The cover 22 has a plurality of lugs 22 on the circumferential edge thereof for facilitating rotation of the cover 22. The plug 8 has a recess formed with internal threads and an orifice 81 on the bottom thereof. The adjusting disc 4 has a center through hole 41 and a circular groove 42 on the bottom side thereof. The circular groove 42 is gradually decreased in depth. The adjusting disc 4 is mounted on the container 1 and provided with projections 43 on the circumferential edge thereof. The tubular member 5 has an upper and a lower portions. The upper portion of the tubular member 5 is formed with a plurality of circular fins 51 for heat dissipation, a hole 52 under the fins 51 for letting in air to mix with fuel gas, and a circular flange 53 under the hole 52. The lower portion of the tubular member 5 is formed with threads 54 adapted to engage with the internal threads of the plug 8 and an outlet 55 below the threads 54. The funnel-shaped member 6 is mounted on the upper portion of the tubular member 5. The burner 7 is arranged inside the funnel-shaped member 6 and sleeved over the upper portion of the tubular member 5. The burner 7 is provided with a plurality of fins 71 for heat dissipation. The two packing rings 3 are fitted on the neck 56 of the tubular member 5.

When in use, the adjusting disc 4 is turned to adjust the clearance between the lower end of the tubular member 5 and the inner bottom side of the plug 8 thereby adjusting the flowrate of the fuel gas passing through the center hole 81 of the plug 8. As the adjusting disc 4 is turned to open the gas stove, fuel gas will flow into the plug 8 through the center hole 81 and then the orifice 81 at the lower end of the tubular member 5. Then, the fuel gas will continue to flow upwardly through the tubular member 5. In the meantime, air will be attracted into the tubular member through the hole 52 to mix with the fuel gas. Finally, the mixture gas will go upwardly to the burner 7 and may then be ignited to provide a fire for cooking or the like.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A stove comprising:

a cylindrical casing having open top;

a cover engaged with said open top of said cylindrical casing and having a center hole in which is fitted a plug, said plug having a recess formed with internal threads and an orifice on a bottom thereof;

a stop pin provided on a top of said cover;

an adjusting disc having a center through hole and a circular groove on a bottom side thereof adapted to engage with said stop pin;

a tubular member having an upper and a lower portions, said upper portion having an air hole for letting in air to mix with fuel gas, said lower portion being formed with threads adapted to engage with said internal threads of said plug and an outlet below said threads;

a funnel-shaped member mounted on said upper portion of said tubular member; and a burner arranged inside said funnel-shaped member and sleeved over an upper portion of said tubular member.

2. The gas stove as claimed in claim 1, wherein said container has a check valve at a bottom thereof.

3. The gas stove as claimed in claim 1, wherein said circular groove of said cover is gradually decreased in depth plurality of lugs on a circumferential edge thereof.

4. The gas stove as claimed in claim 1, wherein said upper portion of said tubular member is formed with a plurality of circular fins above said air hole.

5. The gas stove as claimed in claim 1, wherein said upper portion of said tubular member has a circular flange under said air hole.

6. The gas stove as claimed in claim 1, wherein said burner is provided with a plurality of fins.

7. The gas stove as claimed in claim 1, further comprising two packing rings fitted in a neck of said lower portion said tubular member.

* * * * *